US005811944A

United States Patent [19]

Sampayan et al.

[11] Patent Number: 5,811,944

[45] Date of Patent: Sep. 22, 1998

[54] ENHANCED DIELECTRIC-WALL LINEAR ACCELERATOR

[75] Inventors: Stephen E. Sampayan, Manteca; George J. Caporaso, Livermore; Hugh C. Kirbie, Dublin, all of Calif.

[73] Assignee: The United States of America as represented by the Department of Energy, Washington, D.C.

[21] Appl. No.: 773,804

[22] Filed: Dec. 18, 1996

Related U.S. Application Data

[63] Continuation-in-part of Ser. No. 668,669, Jun. 25, 1996.

[51] Int. Cl.[6] ..... H05H 9/00

[52] U.S. Cl. ..... 315/505; 315/500; 315/507

[58] Field of Search ..... 315/505, 500, 315/507, 5.42, 5.41, 5.47, 5.46, 5.16, 359.1, 360.1

[56] References Cited

U.S. PATENT DOCUMENTS 2,465,840 3/1949 Blumlein ..... 333/20

*Primary Examiner*—Sandra L. O'Shea
*Assistant Examiner*—Jay M. Patidar
*Attorney, Agent, or Firm*—William C. Daubenspeck; William R. Moser; Paul A. Gottlieb

[57] ABSTRACT

A dielectric-wall linear accelerator is enhanced by a high-voltage, fast rise-time switch that includes a pair of electrodes between which are laminated alternating layers of isolated conductors and insulators. A high voltage is placed between the electrodes sufficient to stress the voltage breakdown of the insulator on command. A light trigger, such as a laser, is focused along at least one line along the edge surface of the laminated alternating layers of isolated conductors and insulators extending between the electrodes. The laser is energized to initiate a surface breakdown by a fluence of photons, thus causing the electrical switch to close very promptly. Such insulators and lasers are incorporated in a dielectric wall linear accelerator with Blumlein modules, and phasing is controlled by adjusting the length of fiber optic cables that carry the laser light to the insulator surface.

15 Claims, 4 Drawing Sheets

ENHANCED DIELECTRIC-WALL LINEAR ACCELERATOR

COPENDING APPLICATIONS

This application is a continuation-in-part of U.S. patent application Ser. No. 08/668,669, filed Jun. 25, 1996, and incorporates by reference such application and other identified as U.S. patent application Ser. No. 08/834,977, filed Apr. 7, 1997, which is continuation of 08/561,203, filed Nov. 9, 1995, now abandoned.

The United States Government has rights in this invention pursuant to Contract No. W-7405-ENG48 between the United States Department of Energy and the University of California for the operation of Lawrence Livermore National Laboratory.

BACKGROUND OF THE INVENTION

1. Field of the Invention

The present invention relates to linear accelerators and more particularly to dielectric-wall linear accelerators that operate at voltage gradients that exceed twenty megavolts per meter.

2. Description of Related Art

Particle accelerators are used to increase the energy of electrically-charged atomic partides, e.g., electrons, protons, or charged atomic nuclei, so that they can be studied by nuclear and particle physicists. High energy electrically-charged atomic particles are accelerated to collide with target atoms, and the resulting products are observed with a detector. At very high energies, the charged particles can break up the nuclei of the target atoms and interact with other particles. Transformations are produced that help to discern the nature and behavior of fundamental units of matter. Particle accelerators are also important tools in the effort to develop nuclear fusion devices.

The energy of a charged particle is measured in electron volts, where one electron volt is the energy gained by an electron when it passes between electrodes having a potential difference of one volt. A charged particle can be accelerated by a static or traveling electric field toward a charge opposite that of the charged particle. Beams of particles can be electrically or magnetically focused, and superconducting magnets can be used to advantage. Early machines in nuclear physics used static, or direct, electric fields. Most modern machines, particularly those for the highest particle energies, use alternating fields, where particles are exposed to the field only when the field is in the accelerating direction. When the field is reversed in the decelerating direction, the particles are shielded from the field by various electrode configurations.

Because electrons are much lighter than ions, their velocity at a given energy is significantly higher than that of ions. The velocity of a one-MeV proton is less than five percent that of light. In contrast, a one-MeV electron has reached ninety-four percent of the velocity of light. This makes it possible to operate electron linacs at much higher frequencies, e.g., about 3,000 MHz. The accelerating system for electrons can be a few centimeters in diameter. The accelerating systems for ions need diameters of a few meters. Electron linacs having energies of ten to fifty MeV are widely used as x-ray sources for treating tumors with intense radiation.

Conventional pulsed power systems for induction cells include devices constructed of nested pairs of coaxial transmission lines, so-called "Blumlein" devices. See, U.S. Pat. No. 2,465,840, issued in 1948 to A.D. Blumlein, which is incorporated here by reference. A step-up transformer or Marx bank slow charging system is connected between an intermediate conductor of the Blumlein and a grounded outer conductor. The output is taken between an inner conductor and the outer conductor which then provides a coaxial drive signal to the induction cell. When the Blumlein is fully charged, there is no net output voltage. But when a switch is closed to ground, a voltage wave is caused to propagate between the inner and outer conductor of the line to the output. This voltage feeds the induction cell with a relatively fast pulse, e.g., on the order of tens of nanoseconds. The switch most often used includes high voltage electrodes separated by an insulating gas, e.g., a spark gap. Conventionally, a third trigger electrode is placed between the main two spark gap electrodes and voltage pulsed to initiate a breakdown. Alternatively, a laser is used to ionize the insulating gas. The breakdown of the gas allows current to flow with a very low resistance. But such systems are repetition-rate limited by the recovery time of the spark gap switch. Higher repetition rates can be realized by blowing the insulating gas through the spark gap switch. Even so, such types of switches are limited to repetition rates that do not exceed several kilohertz.

SUMMARY OF THE INVENTION

An object of the present invention is to provide an enhanced dielectric-wall linear accelerator.

Another object of the present invention is to provide a dielectric-wall linear accelerator that can output a tight beam with very little divergence.

A further object of the present invention is to provide dielectric-wall linear accelerator for generating neutrons without using tritiated targets.

Briefly, a dielectric-wall linear accelerator embodiment of the present invention comprises a stack of paired fast and slow Blumlein modules. The stack is structured in the shape of a hollowed round cylinder. The inside diameter defines a core through which charged particles are sourced at one end by an emitter and coaxially accelerated out the opposite end. In order to withstand acceleration gradients that can reach twenty MV/meter, a novel insulator structure is used to construct a dielectric sleeve that fits tightly into the core. The novel insulator structure comprises flat annular rings of fused silica with thicknesses on the order of one millimeter arranged with their planes perpendicular to the core axis. At least one metal is deposited and diffused into each of the two sides of the fused-silica flat-annular rings. Eutectic alloys can also be used with metal alloy parts A and B on adjacent faces. The metalized fused silica flat annular rings are fused together into one hollow cylinder by applying enough heat and/or pressure to the stack to weld, braze, or solder the metal-to-metal interfaces. Exothermic multilayer foils can also be sandwiched in the stack under pressure, and then ignited to flash bond the fused silica flat annular rings together. Alternative embodiments of the present invention have either a plain window, a conductive foil, or a deuterated target at the opposite end of the core to maintain a vacuum, focus the charged particle beam, or generate neutrons when the charged particles being accelerated are deuterium ions. The conductive foils include graphite windows that can get hot without melting. The emitters for electrons can be velvet fabric or field emission semiconductor structures. The emitters for ions can be electric arc plasma types that liberate deuterium ions from deuterated titanium.

An advantage of the present invention is that a dielectric-wall linear accelerator is provided that is compact and efficient.

Another advantage of the present invention is that a dielectric-wall linear accelerator is provided that can emit low-divergence beams that concentrated deliveries of charged particles at distant targets.

A further advantage of the present invention is that a dielectric-wall linear accelerator is provided that can function as a neutron source.

DETAILED DESCRIPTION OF THE INVENTION

Figure 1A:
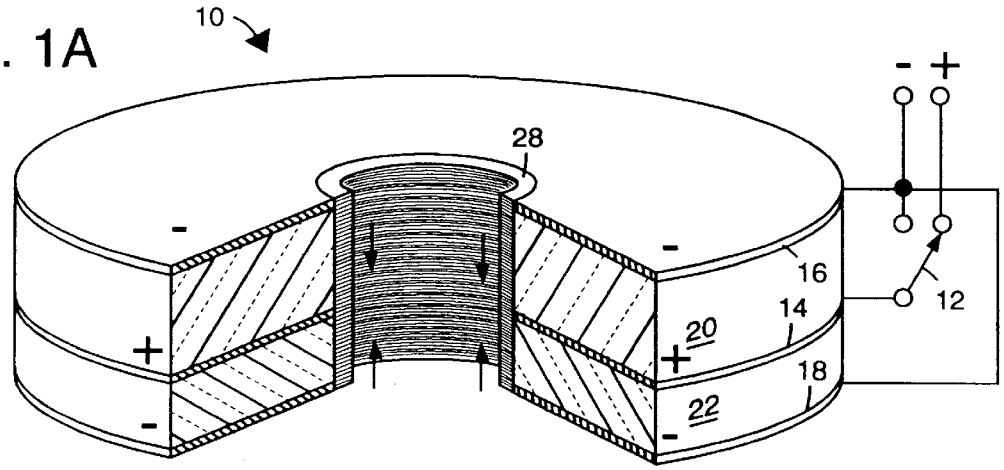
FIGS. 1A–1C are a time-series of cutaway-perspective diagrams of a compact linac embodiment of the present invention related to the closure of an initiation switch.
Figure 1B:
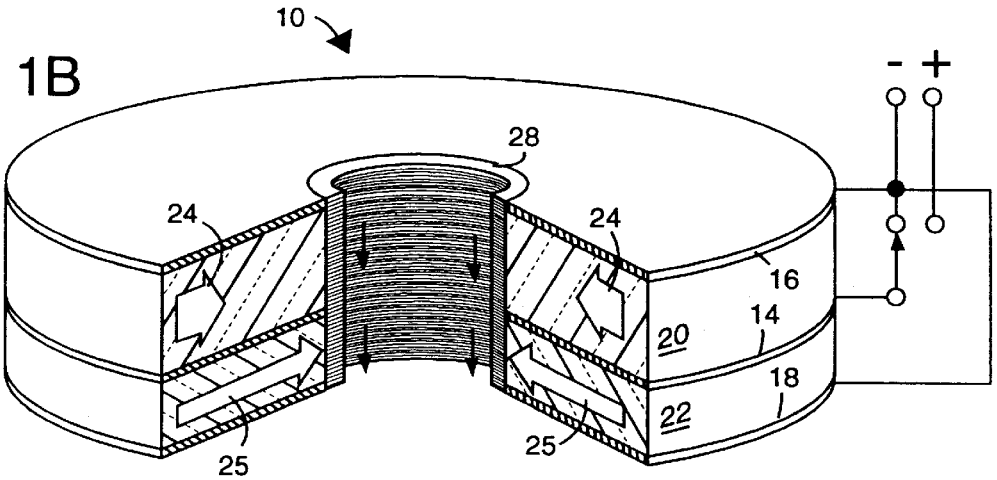
Figure 1C:
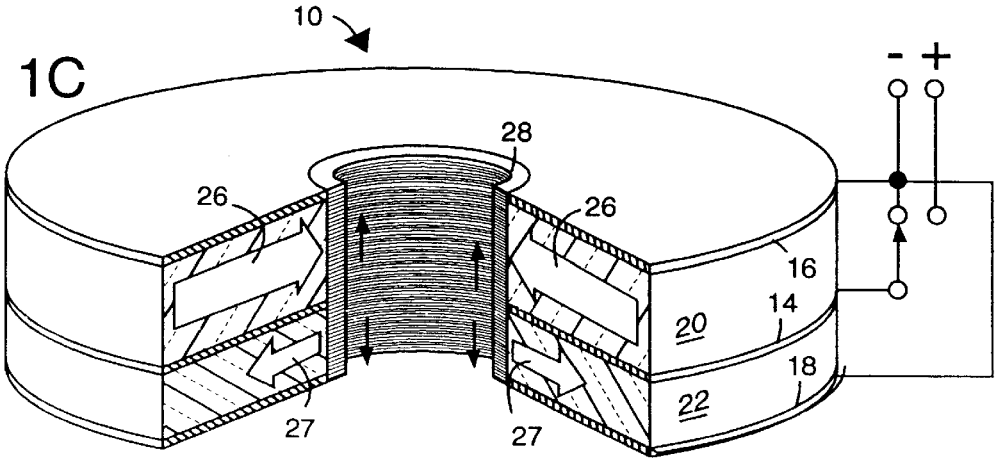

FIGS. 1A–1C illustrate a single accelerator cell for Blumlein linear accelerator (linac) module of the present invention, referred to herein by the general reference numeral 10. FIGS. 1A–1C represent a time-series that is related to the state of a switch 12. In a first condition at $t_O$, illustrated in FIG. 1C, the switch 12 is connected so as to short circuit a middle conductive plate 14 to a pair of top and bottom conductive plates 16 and 18 at their respective outer perimeters. The switch 12 is then connected, as in FIG. 1A, to positively charge the middle conductive plate 14 to a high voltage. A dielectric layer 20 with a relatively high dielectric constant, $\epsilon_1$, separates the conductive plates 14 and 16, for example titanium dioxide may be used. A dielectric layer 22 with a relatively low dielectric constant, $\epsilon_2$, separates the conductive plates 14 and 18. Preferably, the dielectric constant $\epsilon_1$ is nine times greater than the dielectric constant $\epsilon_2$. The middle conductive plate 14 is set closer to the bottom conductive plate 18 than it is to the top conductive plate 16, such that the combination of the different spacing and the different dielectric constants results in the same characteristic impedance on both sides of the middle conductive plate 14. The characteristic impedance for both halves is preferably the same. Even so, the propagation velocities of signals through the respective half will not be equal. The higher-dielectric-constant half with dielectric layer 20 is much slower. The two different propagation velocities are represented by a short fat (slow) arrow 24 and a long thin (fast) arrow 25 in FIG. 1B. The fast half is the first to reflect at the core, and is represented in FIG. 1C by a long fat (slow) arrow 26 that just reaches the core, while a reflected short thin (fast) arrow 27 is well on its way to completing a round trip.

The single accelerator cell is electrically equivalent to two radial transmission lines that are filled with different dielectric materials. The line having the lower dielectric constant fill material is called the "fast" line, and the one having the higher dielectric constant fill material is termed the "slow" line. Before firing a shot, both lines are oppositely charged so that there is no net voltage along the inner length of the assembly. After the lines have been fully charged, a shot is fired by closing switch 12. This shorts the outside of both lines at the outer diameter of the single accelerator cell to ground. An inward propagation of the voltage waves 24 and 25 is launched. These carry opposite polarities to the original charge. Ultimately, a zero net voltage will be left behind in the wake of both waves.

But when the fast wave 25 hits the inner diameter of its line, it reflects back from the open circuit it encounters. Such reflection doubles the voltage amplitude of the wave 25 and causes the polarity of the fast line, seen at the core, to reverse. This is because twice the original charge voltage is subtracted from the original charge voltage in the wave 25 at the reflection. Albeit for only an instant longer, the voltage on the slow line at the inner diameter will still be at the original charge level and polarity, and so it adds to the fast line's new polarity. After the wave 25 arrives but before the wave 24 arrives at the inner diameter, the field voltages on the inner ends of both lines are oriented in the same direction and add to one another, as shown in FIG. 1B.

Such adding of fields produces an impulse field that can be used to accelerate a charged particle beam, e.g., comprising electrons or ions. Such impulse field is neutralized, however, when the slow wave 24 eventually arrives and reverses the polarity of the slow line, as is illustrated in FIG. 1C. The time that the impulse field exists can be extended by increasing the distance that the voltage waves 24 and 25 must traverse. One way is to simply increase the outside diameter of the single accelerator cell. Another, more compact way is to replace the solid discs of the conductive plates 14, 16 and 18 with one or more spiral conductors that are connected between conductor rings at the inner and/or outer diameters, as is illustrated in FIG. 6. For example, the spiral conductors may be patterned in copper clad using standard printed circuit board techniques on both sides of a fiberglass-epoxy substrate that serves as the dielectric layer 22. Multiple ones of these may then be used to sandwich several dielectrics 20 to form a stack.

The slow line can made be made slower still, by constructing it, for example, to electrically implement a series-inductor/parallel-capacitor (L-C) delay line. By analogy, radio frequency antennas are made to look electrically longer by inserting an inductor in series with the driven element. Conversely, capacitors are inserted in series to electrically shorten an antenna.

In an alternative embodiment of the present invention, a single spiral conductor in each conductor ring may be used to provide an induction kick or induction squeeze to the charged particles being accelerated. Such spiral conductors are configured as planar inductors. The inductors are useful for generating magnetic fields that act on the charged particles being accelerated, or for constructing an L-C delay line that further delays the arrival of the switch initiation wave propagation from the outer perimeter to the core, or both. Such spiral inductors may have opposite rotations for opposite electrical polarities to have additive or subtractive magnetic effects on the charged particles being accelerated coaxially within the insulator sleeve 28.

The illustration of FIGS. 1A–1C are intended to represent the insulator sleeve 28 as being constructed of many thin layers of insulating materials interdigitated with finely spaced floating metal electrodes. A low performance insulator that could be used in modest applications where vacuum sealing and contamination are not important, e.g., insulators marketed by Tetra Corporation (Albuquerque, N. Mex.) under the trademark MICROSTACK. See, J. Elizondo and A. Rodriguez, Proc. 1992 15th Int. Symp. on Discharges and Electrical Insulation in Vacuum (Vde-Verlag Gmbh, Berlin, 1992), pp. 198–202. The spatial period of such alternations in the insulator sleeve 28 preferably are in the approximate range of 0.1–1.0 millimeters (mm), albeit the lower end of the range has yet to be determined precisely because very specialized equipment and instruments are necessary.

A widely held view of the process by which an insulator-vacuum interface breaks down contends that there is an enhancement of the electric field at triple points, e.g., points where there is an intersection of a vacuum, a solid insulator and an electrode. Electrons that are field emitted from a triple point on a cathode initially drift in the electric field between the end plates of the insulator which is a dielectric and is polarized by the electrons. This results in an electric field which attracts the electron into the surface of the insulator. The electron collisions with the surface can liberate a greater number of electrons, depending upon the electron energy of the collisions. This can lead to a catastrophic event in which the emission of these electrons charges the insulator surface, leads to more collisions with the surface, and the release of even more electrons. This growing electron bombardment desorbs gas molecules that are stuck to the insulator surface and ionizes them, creating a dense plasma which then electrically shorts out the surface of the insulator between the electrodes, e.g., secondary electron emission avalanche (SEEA).

The scale length for the electron hopping distance along a conventional insulator's surface can be on the order of a fraction of a millimeter to several millimeters. When isolated conductive lamination layers are alternated with insulator lamination layers, SEEA current is prevented such that no current amplification can take place. The electron current amplification due to secondary emission is stopped when the electrode spacing is comparable to the electron hopping distance. Direct bombardment of the surface by charged particles or photons can still liberate electrons from the insulator, but the current will not avalanche. Surface breakdown then requires the bombardment by charged particles or photons that is so intense that adsorbed gas is ionized or enough gas is released from the surface that an avalanche breakdown in the gas occur between the plates.

Preferably, the sleeve 28 is fabricated from a high performance, high gradient dielectric material used to line the inner diameter of the linear accelerator to provide a dielectric wall. A charged particle source is positioned at one end of the dielectric wall 28, and the charged particles produced are accelerated along the central axis. The dielectric sleeve 28 is preferably thick enough to smooth out the alternating fields at the central axis. Such alternating fields are represented by the vertical arrows in Pigs. 1A and 1C inside the walls. The dielectric sleeve 28 functions to prevent voltage flashover between the inside edges of the conductive plates 14, 16 and 18, therefore the sleeve 28 should be tightly fitted or molded in place. The overall dielectric constant of the material bulk of the sleeve 28 is preferably four times that of the dielectric layer 22. Thus the preferred ratio of dielectric constants amongst the dielectrics 22 and 20 and the sleeve 28 is 1:9:4.

Figure 2:
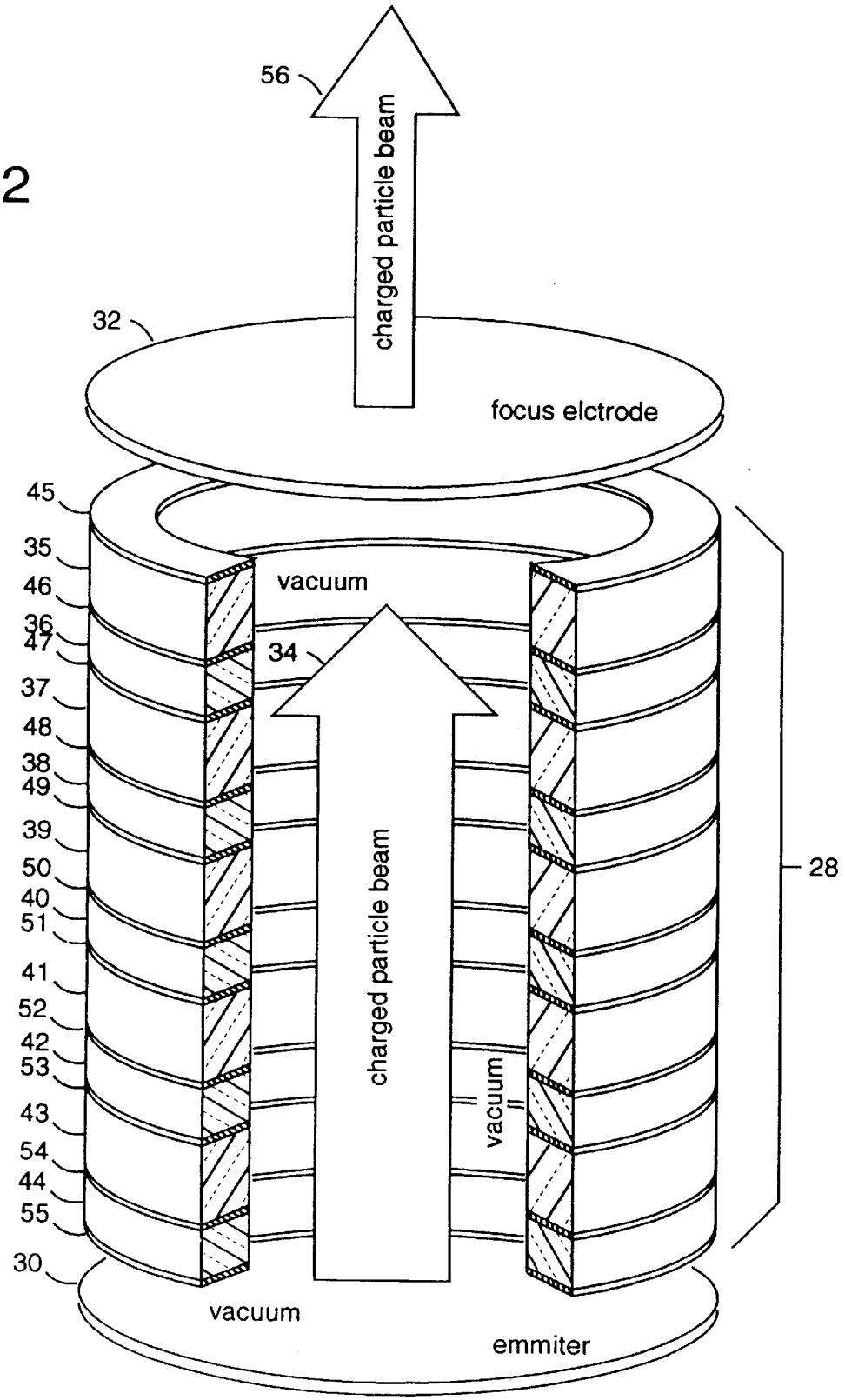
FIG. 2 is a partially cut away exploded assembly view of a focus electrode and emitter associated with the dielectric sleeve used to line the core of the compact linac shown in FIGS. 1A–1C.

FIG. 2 illustrates the dielectric sleeve 28 in more detail and its association with a charged particle emitter 30 and a focus electrode 32. The charged particle emitter 30 is an anode when ions are being accelerated, and is a cathode when electrodes are being accelerated. A charged particle beam 34 is sourced by the emitter 30 and accelerated toward the focus electrode 32 by one or more accelerator cells arranged in electrical parallel and in mechanical series. The emitters used for electrons can be velvet fabric or field emission semiconductor structures. The emitters for ions can be electric arc plasma types that liberate deuterium ions from deuterated titanium. In the latter case, the focus electrode 32 can be substituted by a deuterated titanium target cathode connected to a negative high voltage power supply, with the positive connected to the emitter 30, e.g., >150 kV. Such deuterated titanium target cathode is useful for converting accelerated deuterium ions into neutrons with energies of 2.45 MeV and greater.

The dielectric bulk of the sleeve 28 preferably comprises a fused stack of insulator layers 35–44 having a period that does not exceed one millimeter. For example, the fused stack of insulator layers 35–44 can be fabricated from bulk dielectric materials such as, fused silica, quartz glass, alumina, ceramic sapphire, etc., Given enough numbers to the stack, any longitudinal length may be constructed. Typical outside diameters are two inches with typical inside diameters of one inch. A series of conductive layers 45–55 interdigitates the insulator layers 35–44. The structure is equivalent to a capacitive voltage divider, and may even retain a charge that is divided amongst the many layers from the cathode to the anode. The conductive layers 45–55, as represented in FIG. 2, may be fabricated as separate metal foils and plates, or as one or more evaporated metals diffused into the respective surfaces of the insulator layers 35–44.

The conductive layers 45–55 are used during fabrication to hard seal insulator layers 35–44 one to the another. Pressure and heat welding, brazing, and soldering techniques may be used. The reverse should be possible too, e.g., fabricating flat metal conductor rings with oxides or other dielectrics on their mating surfaces, and then chemically bonding the metal oxides or other dielectrics together. For insulators fused by metal-to-metal bonding, each conductive layer 45–55 may comprise a eutectic two-part alloy with corresponding constituents that are deposited or diffused into respective faces of the insulator layers 35–44. Each conductive layer 45–55 may alternatively comprise a multilayer nanostructure foil initiator that is ignited to bond metals that are already deposited or diffused into respective faces of the insulator layers 35–44. Such multilayer nanostructure foil initiators are described by Troy Barbee, Jr., et al., in U.S. Pat. Nos. 5,538,795, and 5,547,715, respectively issued Jul. 23, 1996 and Aug. 20, 1996, and are incorporated herein by reference.

In some applications, it may be useful to arrange the insulator layers 35–44 and interdigitated conductive layers 45–55 as concentric cylinders that fit one inside the other in onion-skin fashion. Such concentric cylinders would be positioned coaxial to the charged particle beam 34, and insulated by a dielectric sleeve from the inner extents of conductive plates 14, 16, and 18 (FIGS. 1A–1C).

The focus electrode 32 is used to squeeze the charged particle beam 34 into a narrower beam 56, e.g., by reducing the e-field of beam 34. When the charged particle beam 34 comprises electrons, an e-field is created within the charged particle beam 34 that will cause it to diverge. A conductive foil placed in front of the charged particle beam 34 will short out such e-field and stop the de-focusing of the beam. Preferred embodiments use focus electrodes 32 made of graphite or carbon, because such do not melt when high operating temperatures are experienced. Other charged particle beam focusing methods can also be used, including those that are conventional.

Figure 3:
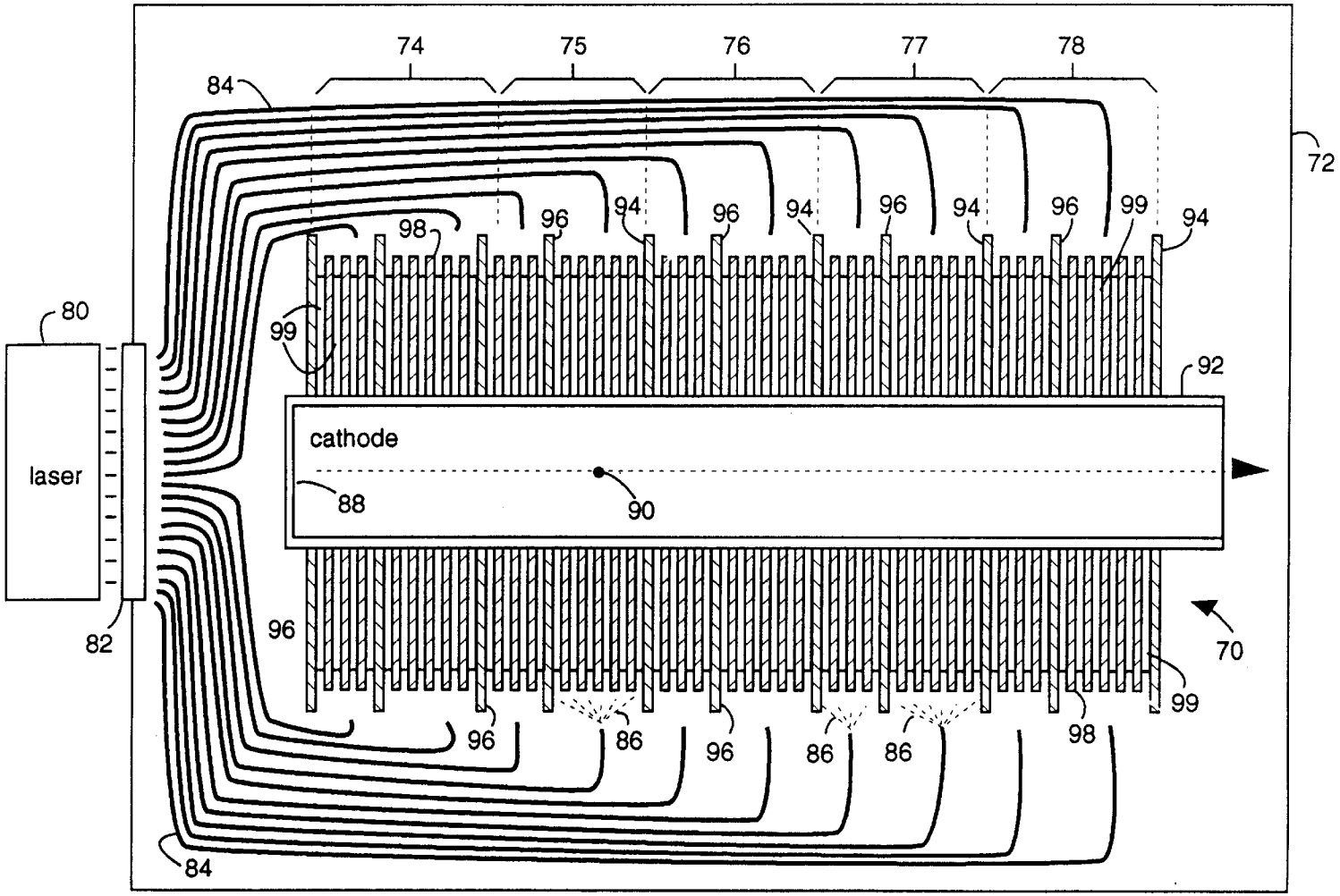
FIG. 3 is a cross-sectional diagram of multiple stacked, laser-switch initiated dielectric wall accelerator embodiment of the present invention, wherein the view is taken along the longitudinal axis of a core disposed within a vacuum.

FIG. 3 illustrates a suitable closing switch mechanism that can operate at the high voltage gradients required by accelerator cell embodiments of the present invention. A laser is used to paint a path on the outside diameter of the cells to initiate a surface flashover. As in FIG. 1A, when switch 12 charges plate 14 to a high voltage, the outer diameter surface of the fast and slow lines will develop a high electric field stress. So a surface breakdown is near at hand, and a fluence from a laser can be all that is needed for a trigger. The advantage of such breakdowns is they are very prompt, so this mechanism makes an ideal closing switch for applications where timing is critical. Preferably, the line illuminated on the surface by the laser provides a prompt flux of photons that are guaranteed strong enough to precipitate a breakdown at the nominal charge potentials.

In tests, a frequency multiplied Nd-YAG laser (1.06$\mu$) was used to throw down line focus approximately one millimeter by one centimeter along the outside surface of the accelerator cells across the outer perimeters of the electrodes. The fluence required to initiate a breakdown was observed to be about a few milliJoules per switch point. Laser-induced surface flashover switching appeared to work well at gradients of 150 kV/cm, and two kiloamp switch currents have been measured.

FIG. 3 illustrates a multi-stage linac system embodiment of the present invention, referred to herein by general reference numeral 70. The 70 is disposed within a vacuum 72. The system 70 comprises a set of five Blumlein linac modules 74–78 that are each similar to the Blumlein linac modules 10 of FIGS. 1A–1C. In a preferred embodiment, a frequency doubled, tripled, or quadrupled Nd-YAG laser 80 is used to produce a laser light pulse that is passed through a port 82 and routed through a bundle of fiber optic cables 84 to the stack of Blumlein linac modules 74–78, e.g., with each linac receiving twelve azimuthally spaced lines of focus 86. Lines of focus that were one millimeter by one centimeter on the surface have produced good switching results. A velvet cloth field emitter can serves as a cathode 88 that emits charged particles. In which case, an electron 90 is accelerated longitudinally within a dielectric sleeve 92, e.g., from left to right in the drawing. Each Blumlein linac module 74–78 includes a first electrode plate 94, e.g., for connection to ground, and a second electrode plate 96, e.g., for charging to a high voltage potential. Each electrode plate 94 and 96 is mechanically similar in construction to the spiral conductor plate of FIG. 7.

The lengths of each group of constituent fiber optic cables in the bundle 84 that are associated with a particular one of the accelerator cells 74–78 may be staged in length relative to the adjacent sets, e.g., in order to phase the switch closings from one accelerator cell to the next in sequence. This would be advantageous in long linacs or where heavier particles 90 are being accelerated and the accelerations possible do not permit a complete axial transition from one end to the opposite end in a single impulse time.

Figure 4:
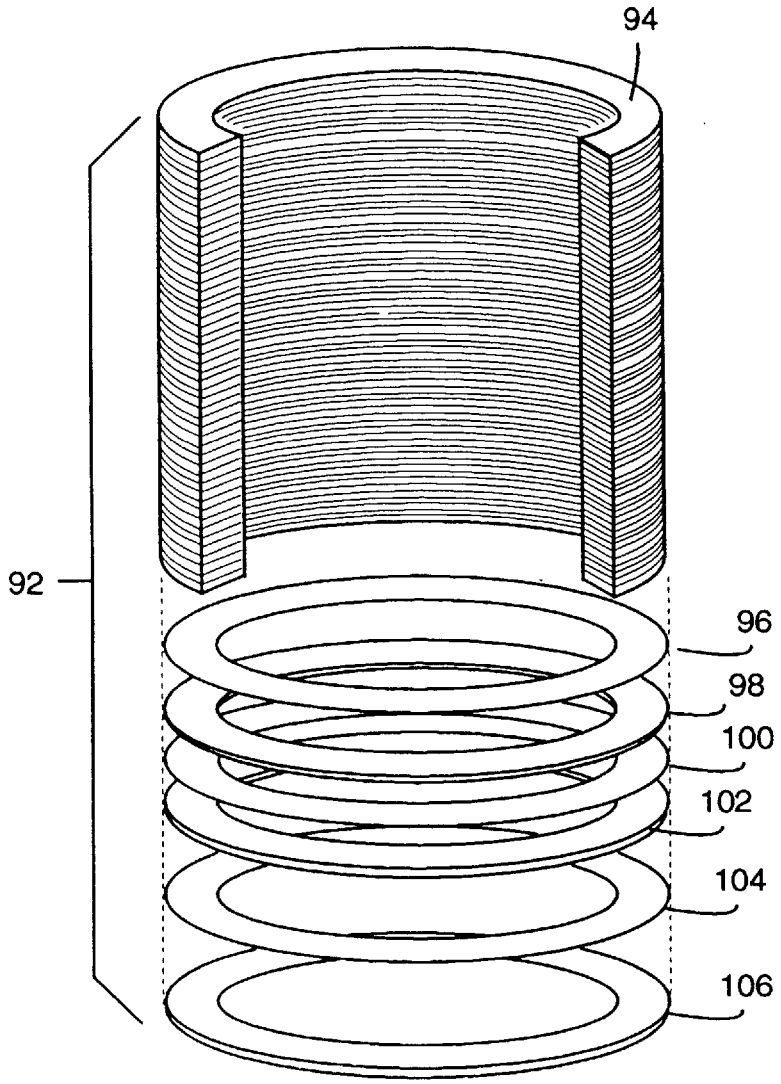
FIG. 4 is a partially cut away exploded assembly view of the dielectric sleeve used to line the core of the compact linac shown in FIGS. 1A–1C and illustrates the use of at least one metal between each fused silica flat annular ring to bond the stack together to hold a vacuum and to provide uniform voltage division for each layer.

FIG. 4 illustrates one possible way to construct the dielectric sleeve 92 of FIG. 3. Alternating metal and dielectric ring layers are coaxially fused together to form a stack 94 (shown in cutaway perspective view in FIG. 4) in the shape of a right cylinder. Alternatively, the stack 94 may be constructed of increasingly smaller inner and outer diameter, but still coaxial, ring layers to form a truncated cone with a missing top apex. The slope of the walls relative to the central longitudinal axis is understood to afford increased resistance to breakdown when the wall angle is less than 45° relative to the central axis, with all other conditions remaining constant. Additional alternating metal and dielectric ring layers 96–106 are also coaxially fused together to further elongate the stack 94 until a particular voltage potential can be comfortably stood off from one end to the other, e.g., 200 KV across 2.0 cm.

Although particular embodiments of the present invention have been described and illustrated, such is not intended to limit the invention. Modifications and changes will no doubt become apparent to those skilled in the art, and it is intended that the invention only be limited by the scope of the appended claims.

The invention claimed is:

1. A linear accelerator (linac), comprising:

a first plane with a first flat planar conductor having a first central hole, and connected to a common potential;

a second plane adjacent to and parallel with the first plane and having a second flat planar conductor with a second central hole that shares an axis with said first central hole, and switchable to both said common potential and a high voltage potential;

a third plane adjacent to and parallel with the second plane and having a third flat planar conductor with a third central hole that shares said axis with said first and second central holes, and connected to a common potential;

a first dielectric volume that fills the space separating said first and second planar conductors and that comprises a first layered insulator assembly with a first dielectric constant;

a second dielectric volume that fills the space separating said second and third planar conductors and that comprises a second layered insulator assembly with a second dielectric constant that is substantially greater than the dielectric constant of said first material, wherein a substantial difference in electrical signal wavefront propagation velocity exists between the first and second dielectric volumes from the outside perimeters of the first through third flat planar conductors and their respective first through third central holes;

a laser directed to focus a fluence of photons on the outside edges of said first through third flat planar conductors for repeated initiation of a short circuit of a high voltage, wherein, an accelerating field is momentarily created in one direction along said axis through said first through third central holes; and a dielectric sleeve fitted through the inside diameters of said first through third central holes as a hollow tube open to pass a particle beam along said axis;

wherein the dielectric sleeve comprises alternating layers of metals and dielectrics in planes orthogonal to said axis.

2. The linac of claim 1, wherein:

the dielectric sleeve further comprises a lamination of alternating sheets of electrically isolated conductors and insulators in a stack is such that each pair of conductor and insulator sheets has a thickness that does not exceed one millimeter.

3. The linac of claim 1, wherein:

said first through third flat planar conductors have circular outside perimeters and the whole linac combines to form a solid cylinder with a coaxial cylindrical hole, said first through third flat planar conductors comprise inner and outer conductive rings between which the electrical length between said inner and outer conductive rings is extended.

4. The linac of claim 1, further comprising:

a dielectric sleeve fitted through the inside diameters of said first through third central holes as a hollow tube open to pass a particle beam along said axis.

5. The linac of claim 4, wherein:

the dielectric sleeve comprises, in overall bulk, a third material with a dielectric constant that is four times that of said first material;

wherein the dielectric constants of said first through third materials have a ratio of 1:9:4.

6. The linac of claim 1, wherein:

said first through third flat planar conductors have circular outside perimeters and the whole linac combines to form a solid cylinder with a coaxial cylindrical hole.

7. The linac of claim 1, further comprising an initiation switch that includes:

a pair of electrodes providing for the application of a high voltage potential;

an insulator assembly disposed between the pair of electrodes and having at least one surface between the pair of electrodes exposed to a vacuum; and light source means for directing a flux of photons to fall on said surface between the pair of electrodes exposed to said vacuum for precipitating an electrical current flashover between the pair of electrodes.

8. The linac of claim 7, wherein:

the light source means includes a frequency multiplied Nd-YAG laser (1.06$\mu$) that provides a prompt flux through a port and lenses that is thrown to a line focus approximately one millimeter by one centimeter along said surface between the pair of electrodes exposed to said vacuum.

9. The linac of claim 7, wherein:

the laser means includes a bundle of fiber optic cables for directing a plurality of prompt photon fluxes independently to a plurality of places on said surface between the pair of electrodes exposed to said vacuum.

10. The linac of claim 7, wherein:

the laser means includes a bundle of fiber optic cables for directing a plurality of prompt photon fluxes independently to a plurality of places on said surface between the pair of electrodes exposed to said vacuum;

wherein different lengths of said fiber optic cable are associated with individual switches to provide for a plurality of time phasings between switch closures for a single pulsed operation of a laser light source.

11. A linear accelerator (linac), comprising:

a plurality of Blumlein modules arranged in a coaxial stack;

a high-voltage, fast rise-time switch that includes a pair of electrodes between which are laminated alternating layers of isolated conductors and insulators;

means for applying a high voltage between the electrodes; and a light source focused along at least one line along the edge surface of said laminated alternating layers of isolated conductors and insulators extending between said electrodes, wherein the initiation of a surface breakdown is accomplished by a fluence of photons, thus causing the switch to electrically close very promptly; and a dielectric sleeve coaxially disposed within the coaxial stack of Blumlein modules that comprises a lamination of alternating sheets of electrically isolated conductors and insulators in a stack is such that each pair of conductor and insulator sheets has a thickness that does not exceed one millimeter.

12. The linac of claim 11, further comprising:

phasing means for delivering said fluence of photons at a sequence of different times to each Blumlein module.

13. The linac of claim 12, wherein:

the phasing means is such that said time delivery sequence is controlled by adjusting the length of a set of fiber optic cables that carry the laser light to the insulator surface.

14. The linac of claim 12, wherein:

each of said Blumlein modules includes both a first and a second type of insulator, wherein said first type has a dielectric constant that is nine times the dielectric constant of said second type.

15. The linac of claim 12, wherein:

the light source is a frequency multiplied type laser coupled in with a fiber optic bundle.

* * * * *